US009422767B2

(12) United States Patent
Russell et al.

(10) Patent No.: US 9,422,767 B2
(45) Date of Patent: Aug. 23, 2016

(54) LADDERS AND RELATED METHODS

(71) Applicant: Wing Enterprises, Incorporated, Springville, UT (US)

(72) Inventors: Brian Russell, Salt Lake City, UT (US); Sean Peterson, Santaquin, UT (US); Kristopher Jones, Provo, UT (US); Bryan Wright, Highland, UT (US)

(73) Assignee: Wing Enterprises, Inc., Springville, UT (US)

( * ) Notice: Subject to any disclaimer, the term of this patent is extended or adjusted under 35 U.S.C. 154(b) by 0 days.

(21) Appl. No.: 14/179,666

(22) Filed: Feb. 13, 2014

(65) Prior Publication Data

US 2014/0224585 A1 Aug. 14, 2014

Related U.S. Application Data

(60) Provisional application No. 61/764,439, filed on Feb. 13, 2013.

(51) Int. Cl.

| | |
|---|---|
| ***E06C 1/18*** | (2006.01) |
| ***E06C 1/14*** | (2006.01) |
| ***E06C 1/16*** | (2006.01) |
| ***E06C 1/393*** | (2006.01) |
| ***E06C 7/08*** | (2006.01) |

(52) U.S. Cl.

CPC ... *E06C 1/18* (2013.01); *E06C 1/14* (2013.01); *E06C 1/16* (2013.01); *E06C 1/393* (2013.01); *E06C 7/082* (2013.01); *Y10T 29/49716* (2015.01)

(58) Field of Classification Search

CPC ..... E06C 1/16; E06C 1/18; E06C 1/38; E06C 1/387; E06C 7/08

USPC ..... 182/115, 116, 117, 118, 119, 124, 125, 182/156, 165

See application file for complete search history.

(56) References Cited

U.S. PATENT DOCUMENTS 622,831 A * 4/1899 Wallach et al. ..... 182/27
1,198,739 A * 9/1916 Marciniak ..... 182/29

(Continued)

FOREIGN PATENT DOCUMENTS

JP 2011084869 A 4/2011

OTHER PUBLICATIONS

PCT International Search Report for corresponding PCT International Patent Application No. PCT/US2014/016041, mailed May 16, 2014.

*Primary Examiner* — Colleen M Chavchavadze
(74) *Attorney, Agent, or Firm* — Holland & Hart LLP

(57) ABSTRACT

Ladders and related methods of using and manufacturing stepladders are provided. In one embodiment, a stepladder is provided that comprises a first assembly hingedly coupled with a second assembly. The first assembly has a pair of spaced apart rails pivotally coupled with one or more rungs. The second assembly includes a pair of space apart rails with one or more bracing members extending therebetween. The first assembly and second assembly are configured to be displaced relative one another such that the stepladder is selectively positionable between a first, deployed state and a second, collapsed state. Upon rotation of the two assemblies relative to one another into a stowed condition, components of the second assembly engage undersurfaces of the rungs effecting rotation of at least a portion of each rung relative to the rails of the first assembly.

10 Claims, 8 Drawing Sheets

(56) References Cited

U.S. PATENT DOCUMENTS

| | | | | | |
|---|---|---|---|---|---|
| 1,243,304 | A * | 10/1917 | Jurkowski | E06C 1/005 | 182/156 |
| 1,633,902 | A * | 6/1927 | Olson et al. | 182/161 | |
| 2,339,593 | A * | 1/1944 | Weston | 182/177 | |
| 2,368,915 | A * | 2/1945 | Brandel | 182/177 | |
| 2,596,521 | A | 5/1952 | Bell | | |
| 2,827,216 | A * | 3/1958 | Napolitano | 182/104 | |
| 3,303,906 | A | 2/1967 | Bouwmeester et al. | | |
| 5,722,507 | A | 3/1998 | Kain | | |
| 5,967,260 | A | 10/1999 | Spak | | |
| 6,347,687 | B1 | 2/2002 | Alim | | |
| 6,454,050 | B2 * | 9/2002 | Gibson et al. | 182/161 | |
| 7,128,187 | B2 * | 10/2006 | Simpson | 182/129 | |
| 7,578,371 | B2 * | 8/2009 | Allred, III | E04F 11/064 | 182/163 |
| 7,849,967 | B2 * | 12/2010 | Gibson et al. | 182/176 | |
| 8,701,828 | B1 * | 4/2014 | Matthew | 182/129 | |
| 2004/0231920 | A1 | 11/2004 | Meeker | | |
| 2006/0249331 | A1 * | 11/2006 | Meeker | 182/165 | |
| 2007/0181368 | A1 * | 8/2007 | Simpson | 182/165 | |
| 2007/0181369 | A1 * | 8/2007 | Gibson et al. | 182/165 | |
| 2009/0229918 | A1 * | 9/2009 | Moss et al. | 182/129 | |
| 2010/0282540 | A1 | 11/2010 | Moss et al. | | |
| 2012/0211305 | A1 | 8/2012 | Moss et al. | | |

* cited by examiner

LADDERS AND RELATED METHODS

CROSS-REFERENCE TO RELATED APPLICATION

This application claims the benefit of U.S. Provisional Patent Application No. 61/764,439 entitled LADDERS AND RELATED METHODS, filed on Feb. 13, 2013, the disclosure of which is incorporated by reference herein in its entirety.

TECHNICAL FIELD

The present invention relates generally to ladders, including stepladders, and methods of making and using such ladders.

BACKGROUND

Ladders are conventionally utilized to provide a user thereof with improved access to elevated locations that might otherwise be inaccessible. Ladders come in many shapes and sizes, such as straight ladders, straight extension ladders, stepladders, and combination step and extension ladders. So-called combination ladders may incorporate, in a single ladder, many of the benefits of multiple ladder designs.

Ladders such as stepladders and step stools are highly utilized by various tradesman as well as homeowners. Such ladders are "self-supporting" in that they do not require the upper end of the ladder to be positioned against a supporting structure, such as against a wall or the edge of a roof. Rather, stepladders (including step stools) include multiple feet (typically either three or four) that are spaced from one another to provide a stable base or foundational structure to support the ladder and a user when placed on, for example, a floor or the ground. This enables a user of the ladder to gain access to elevated areas even though the accessed area may be, for example, in the middle of a room, away from walls or other potential supporting structures that are conventionally required when using a straight ladder or an extension ladder.

For these reasons and others, ladders configured as stepladders or step stools are popular configurations that comprise a large segment of the ladder market. However, there are always areas of potential improvement. For example, the rungs on conventional configurations of stepladders typically exhibit relatively short depth, meaning that there is a relatively small amount of surface area for a user to place their foot on while standing on the rungs of a step ladder. Some ladders have attempted to increase the depth of the rungs in an effort to provide a more comfortable or stable support surface for a user of the ladder. However, often the increase in depth of a rung translates to more bulk in the stored ladder. For example, where the rungs are static and rigidly fixed to the side rails, the rail assembly becomes larger in its overall depth. It follows that that the stored ladder (i.e., when folded or collapsed for storage) exhibits a greater depth as well.

Some ladders, primarily step stools, have utilized rungs that fold or pivot when the ladder is collapsed for storage. However, these ladders typically include struts or braces coupled to the rungs and to another structure on the ladder such as a platform, a rail, or another rung. The struts or braces typically provide a couple of functions with respect to the rungs. First, the struts or braces are coupled to a cantilevered end of the rung to provide structural support to the rung so that it can bear an anticipated load. Second, the struts or braces act as linkages to help "lift" the rung into a folded position when the ladder is being collapsed for storage. Examples of such configurations are shown in U.S. Pat. No. 3,303,906 to Bouwmeester et al. and U.S. Pat. No. 5,722,507 to Kain.

It is a continued desire of the ladder industry to improve the performance of ladders, including stepladders and step stools. For example, it is a continued desire within the ladder industry to provide products that provide a safer working experience for the user, provide added comfort to the user, and enhance the user's experience in a variety of ways.

BRIEF SUMMARY OF THE INVENTION

The present invention relates to various configurations of ladders and to methods relating to the use and manufacture of stepladders.

In accordance with one embodiment, a ladder is provided that comprises a first assembly having a pair of spaced apart rails and at least one rung extending therebetween and a second assembly having a pair of spaced apart rails, second assembly being hingedly coupled with the first assembly. The at least one rung includes a first component extending between and fixedly coupled to the pair of rails of the first assembly and a second component extending between and rotatably coupled to the pair of rails of the first assembly, wherein when in a first position, a surface of the second component abuts a surface of the first component such that rotation in a first direction is prohibited.

In one embodiment the second assembly of the ladder includes at least one bracing member extending between and coupled to the pair of rails of the second assembly, wherein when the second assembly is rotated adjacent the first assembly, the at least one bracing member contacts an undersurface of the second component of the at least one rung. The at least one bracing member may be configured to push against the undersurface of the second component and rotate the second component in a second direction opposite the first direction. In one embodiment, a flexible material component positioned between the first component of the rung and the second component of the rung.

The ladder may further comprise a platform rotatably coupled with the first assembly and configured to selectively engage the second assembly. In one embodiment a locking mechanism may be configured to selectively lock the platform with a component of the second assembly.

The rails of the first assembly may extend beyond a hinge point between the first and second assemblies. A handle may extend between and coupling upper ends of the pair of rails of the first assembly and the handle may further be configured for selective coupling with at least one accessory.

In accordance with another embodiment of the present invention, a method of transitioning a ladder from a deployed state to a stowed state is provided. The method includes rotating a first assembly relative to a second assembly in a first direction until an undersurface of a first rung associated with the first assembly is engaged by a component of the second assembly; and continuing to rotate the first assembly relative to the second assembly in the first direction such that the component of the second assembly effects rotation of at least a portion of the first rung relative to a pair of rails of the first assembly.

The method may further include rotating the at least a portion of the first rung to lie within an envelope defined by the pair of rails of the first assembly and, further, may include maintaining the first rung in a rotated position with the component of the second assembly while the ladder is in the stowed state.

In one embodiment, the method includes engaging an undersurface of a second rung of the first assembly with a second component of the second assembly and continuing to rotate the first assembly relative to the second assembly in the first direction such that the second component of the second assembly effects rotation of at least a portion of the second rung relative to a pair of rails of the first assembly. The at least a portion of the first rung and the at least a portion of the second rung may be rotated in a sequential order upon rotation of the first assembly relative to the second assembly.

In accordance with another aspect of the invention, a ladder is provided comprising a first assembly having a pair of spaced apart rails and at least one rung having a first component extending between and pivotally coupled to the pair of rails, the first component including an abutment surface, a platform surface, and a ramped surface. The ladder also includes a second assembly having a pair of spaced apart rails, second assembly being hingedly coupled with the first assembly. The second assembly includes at least one component located and configured to engage the ramped surface of the first component when the second assembly is displaced relative to the first assembly from a deployed state to a collapsed state.

In one embodiment, the at least one rung component is configured to rotate the at least one rung relative the rails of the first assembly when the second assembly is displaced relative to the first assembly from a deployed state to a collapsed state.

In one embodiment, the first component includes a substantially triangular cross-sectional profile.

In accordance with one embodiment, the at least one rung includes a second component extending between and fixedly coupled with the rails of the first assembly. The second component may include a platform surface and an abutment surface.

The first component may be configured to rotate from a first position to a second position relative to the second component. In one embodiment, when the first component is in the first position, the platform surface of the first component and the platform surface of the second component lie in a substantially common plane. When the first component is in the second position, the platform surface of the first component is positioned at an angle relative to the platform surface of the second component. Additionally, in one embodiment, when the first component is in the first position, the abutment surface of the first component is in abutting contact with the abutting surface of the second component.

In one embodiment, the at least one component includes a brace extending between and fixedly coupled to the rails of the second assembly.

Various features and components of any of the embodiments described herein may be combined with features or components of other embodiments without limitation.

BRIEF DESCRIPTION OF THE SEVERAL VIEWS OF THE DRAWINGS

The foregoing and other advantages of the invention will become apparent upon reading the following detailed description and upon reference to the drawings in which.

Figure 1:
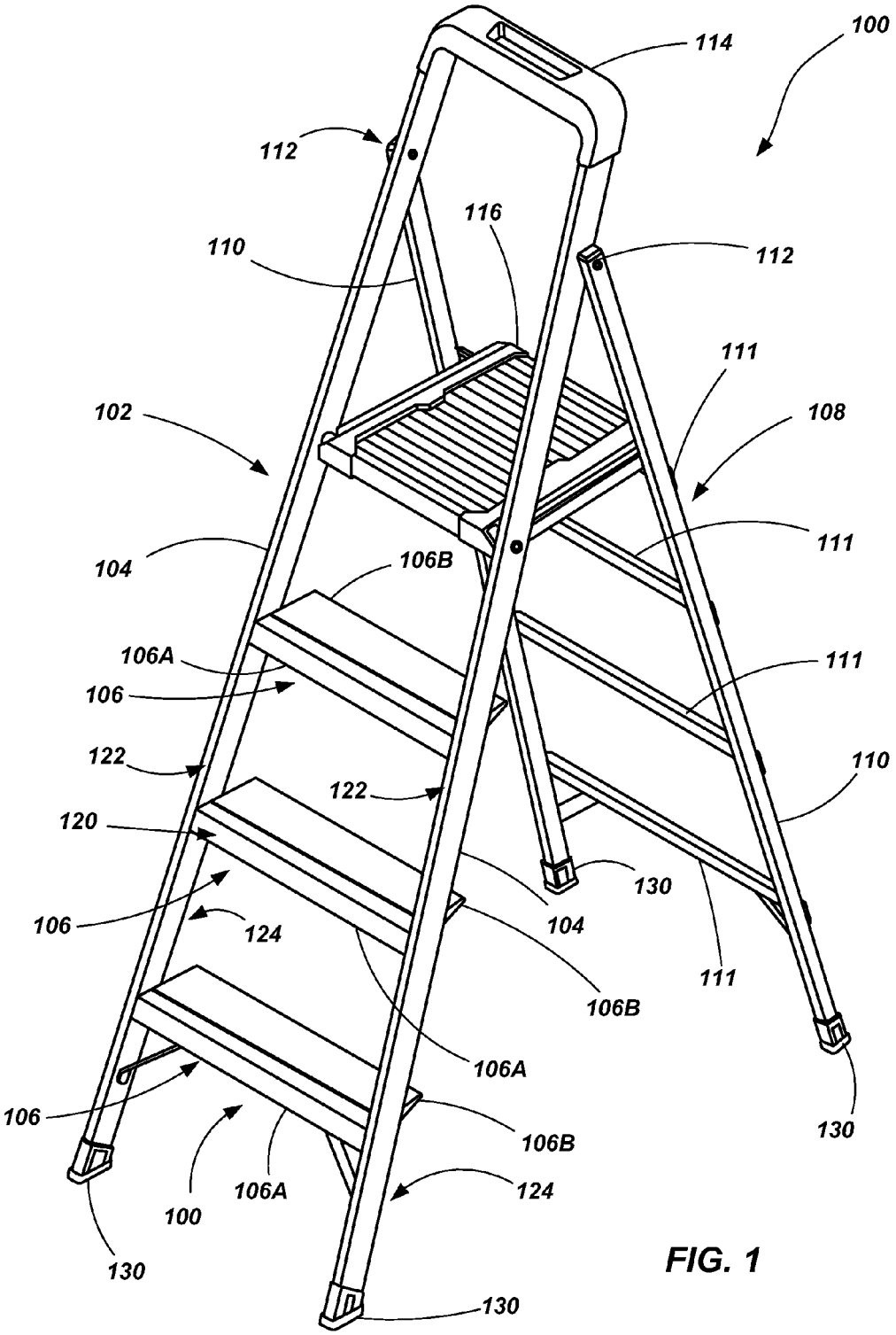
FIG. 1 is a perspective view of a stepladder according to an embodiment of the present invention.

It is noted that numerous photographs are also included in the detailed description and reference should be made to these photographs in association with FIG. 1.

DETAILED DESCRIPTION OF THE INVENTION

Referring generally to FIG. 1, a ladder 100 is shown in accordance with an embodiment of the present invention. The ladder 100 shown in FIG. 1 is configured generally as a platform stepladder and includes a first assembly 102 having a pair of spaced apart rails 104 and a plurality of rungs 106 extending between, and coupled to, the rails 104. The rungs 106 are substantially evenly spaced, parallel to one another, and are configured to be substantially level when the ladder 100 is in an orientation for intended use, so that they may be used as "steps" to support a user as they ascend the ladder 100 and as will be appreciated by those of ordinary skill in the art.

The ladder 100 also includes a second assembly 108 having a pair of spaced apart rails 110. The second assembly 108 includes bracing members 111 or other structural components that extend between the rails 110 to provide a desired level of structural support and strength to the spaced apart rails 110. In some embodiments, the bracing members 111 of the second assembly 108 may be configured as rungs to support a user. The second assembly 108, thus, may be used to help support the ladder 100 when in an intended operational state, such as depicted generally in FIG. 1.

Figure 2:
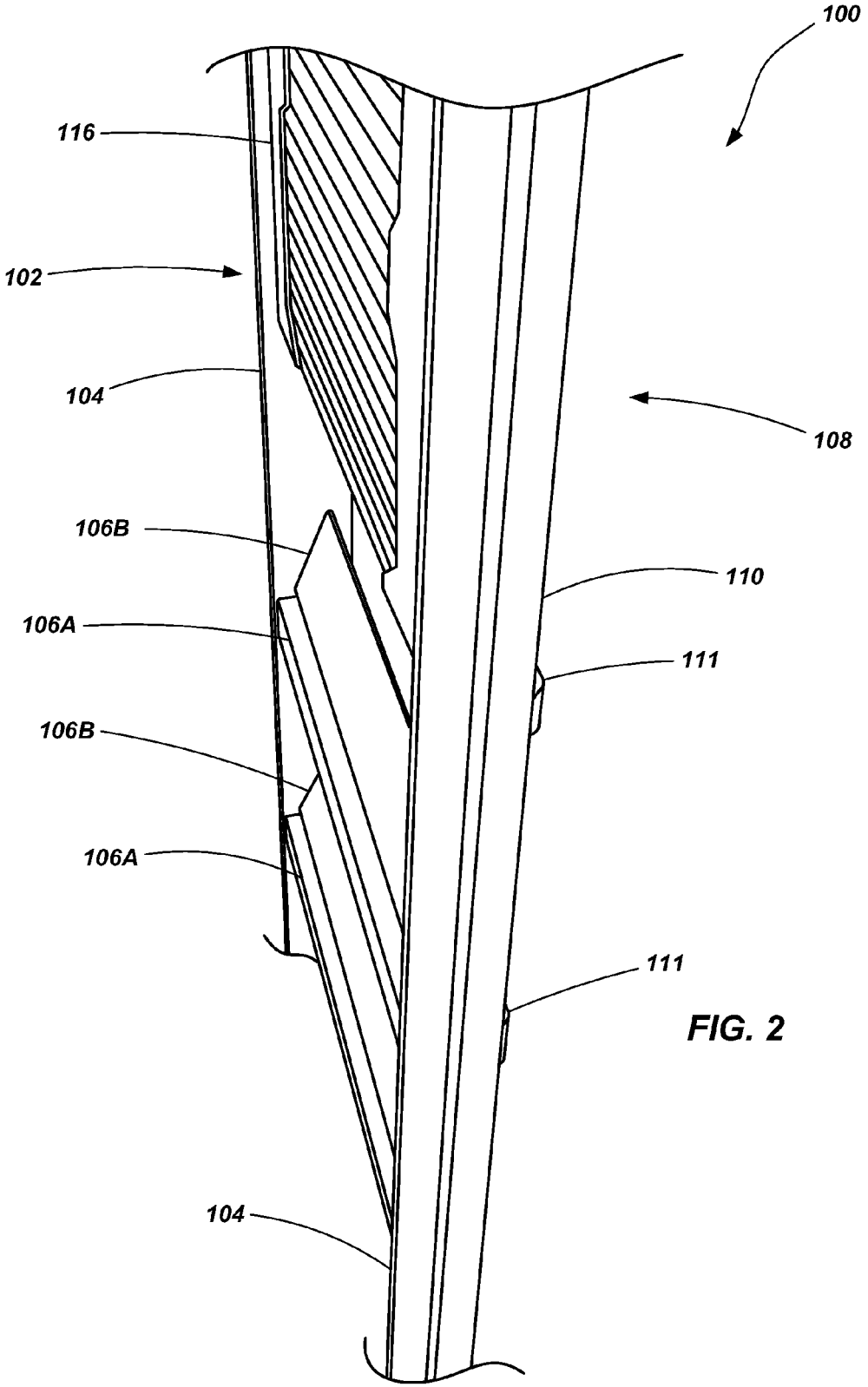
FIG. 2 is a perspective view of a portion of the stepladder shown in FIG. 1 while in a fully closed state.
Figure 3:
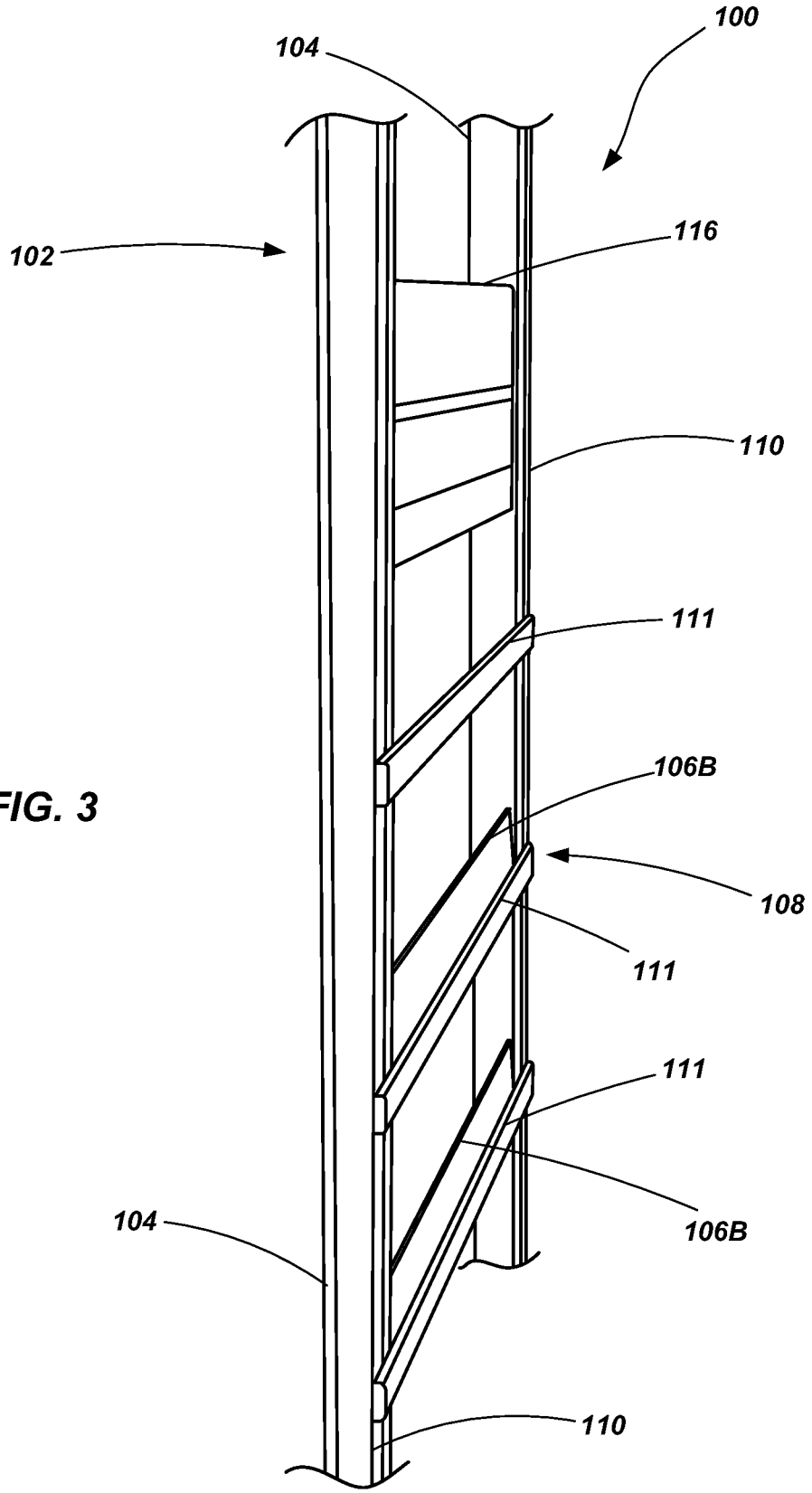
FIG. 3 is another perspective view of a portion of the stepladder shown in FIG. 1 while in a fully closed state.

In the embodiment shown in FIG. 1, hinged or pivoting connections 112 couple the first rail assembly 102 and the second rail assembly 108 together such that the two assemblies 102 and 108 may be folded or collapsed into a stored or stowed state. When in a stowed state, the first rail assembly 102 and the second rail assembly 108 are positioned adjacent each other in a relatively thin profile, such as shown in FIGS. 2 and 3.

It is noted that in the embodiment shown in FIG. 1, the rails 104 of the first assembly 102 extend substantially beyond the hinged connections 112 and are coupled with a handle 114. In such an embodiment, the extended rails 104 and the handle 114 may be used as a handrail to help support or balance a user when they are standing on the ladder 100. It is noted, however, the present invention is applicable to, and contemplated as being incorporated with, other types of ladders including, for example, stepladders having a conventional top cap that is coupled to both of the first and second assemblies.

In the embodiment shown in FIG. 1, a platform 116 is positioned above the rungs 106 and extends from the rails 104 of the first assembly 102 to the rails 110 of the second assembly 108. The platform 116 may be configured to support all, or at least a substantial portion, of a user's feet, thereby providing a comfortable and safe working surface to the user. In the presently described embodiment, the platform 116 is hingedly coupled to the rails 106 of the first assembly 102 and engages a bracing member 111 associated with the second assembly 108. In one embodiment, the platform 116 may simply rest on the associated bracing member 111. In another embodiment, a locking member may be used to selectively couple platform 116 and the associated bracing member 111.

The first and second assemblies 102 and 108 may be formed of a variety of materials and using a variety of manufacturing techniques. For example, in one embodiment, the rails 104 and 110 may be formed of a composite material, such as fiberglass, while the rungs and other structural components may be formed of aluminum or an aluminum alloy. In another embodiment, substantially all of the components of the assemblies may be formed of aluminum or an aluminum alloy. In other embodiments, the assemblies 102 and 108 (and their various components) may be formed of other materials including other composites, plastics, polymers, various metals and metal alloys.

Figure 4:
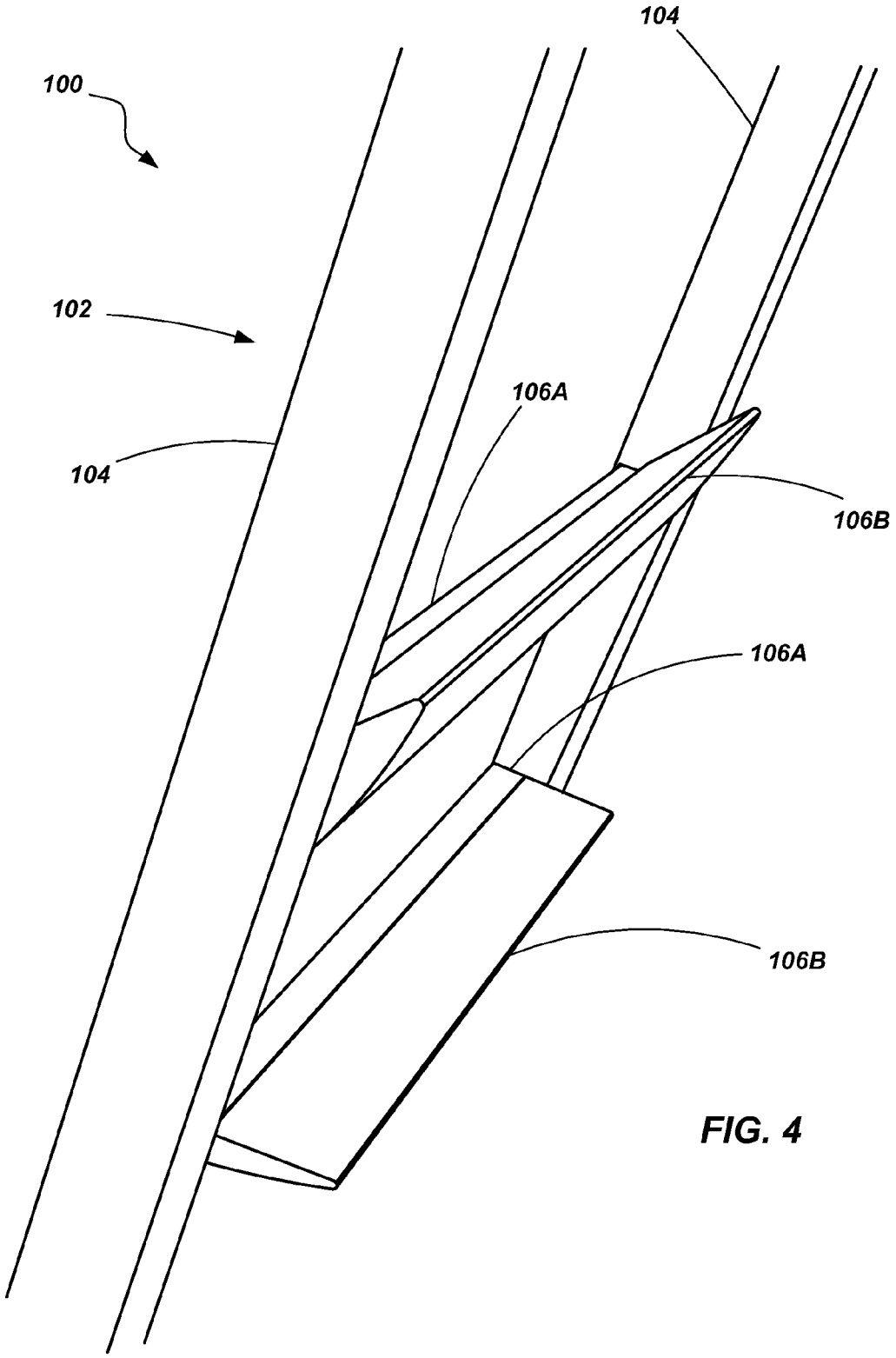
FIG. 4 is a perspective view of a portion of the stepladder shown in FIG. 1.

The rungs 106 of the first assembly 102 are formed of multiple components. In the embodiment shown, the rungs 106 each include a first component 106A that extends between, and is rigidly coupled to, the side rails 104. The first component 106A is located near the outward facing portion of the assembly 102 (i.e., the side which faces a user as they ascend and descend the rungs 106). In one particular embodiment, the first component 106A includes a front surface 120 that is substantially flush with the front surface 122 of the rails 104 such that they define a common plane. The rungs 106 further include a second component 106B that extend between the rails 104 but which are positionable relative to the rails 104. For example, in one embodiment, the second component 106B may be hingedly coupled to the rails 104. In another embodiment, the second component 106B may be hingedly coupled with the first component. In either case, the second component 106B may be rotated relative to both the first component 106A and the rails 104. For example, FIG. 4 shows a portion of the ladder 100 where the second component 106B of one rung (i.e., the uppermost rung shown in FIG. 4) is partially rotated upwards while the second component 106B of an adjacent rung 106 (i.e., of the lowermost rung shown in FIG. 4) remains in a position such that its upper surface lies substantially in a common plane as the upper surface of its associated first component 106A.

Thus, when the ladder 100 is in folded or collapsed into a stored state, the second components 106B of the rungs may be folded up within an envelope that may be defined, in one embodiment, by the rails 104 of the first assembly 102. For example, the envelope may be bound on one side by a plane defined by the front surface 122 of the rails 104, and bound on another side by a substantially parallel plane defined by the back surface 124 of the rails 104. The rotated or folded-up position of the second component 106B may be seen, for example, in FIGS. 2 and 3 where it is positioned within the defined envelope making the ladder 100 compact and easy to store and transport. In another embodiment, the envelope may be defined, for example, between the front surface 122 of the rails 104 of the first assembly 102, and an opposing surface 126 of the rails 110 of the second assembly 108.

It is noted that there are no connecting struts, bracing members or other structural components coupled to the second components 106B of the rungs 106. For example, no structural components are coupled between the cantilevered ends of the second components (i.e., the ends closest to the second assembly 108 as shown in FIG. 1) and other members of the ladder 100 (e.g., the rails 104 or 110, other rungs 106) to provide additional support to the rungs 106 when placed in a cantilevered state to support the weight of a user. Additionally, there are no components coupled between adjacent rungs 106 to assist in folding and unfolding the second components 106B of the rungs. Rather, the second components 106B of the rungs 106, when in a deployed, useable position (i.e., as shown in FIG. 1) may include a surface that abuts against a back surface of the first component 106A, preventing it from rotating further and providing support to the second component 106B when in the cantilevered or deployed position.

Figure 5C:
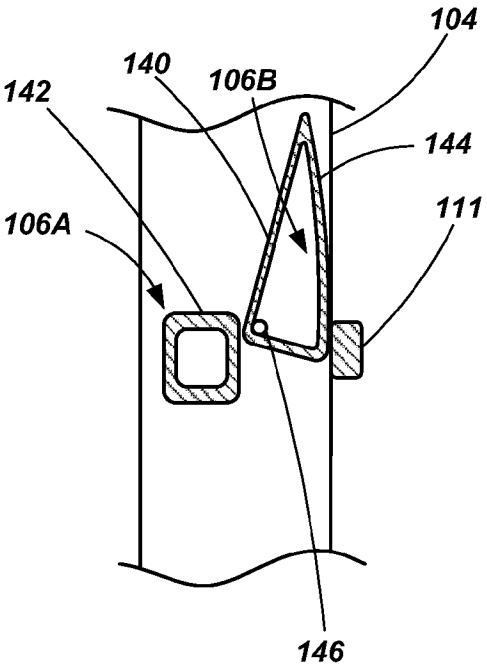
FIGS. 5A-5C show partial cross-sectional views of a portion of the stepladder shown in FIG. 1 in various states of closing or collapsing.
Figure 5B:
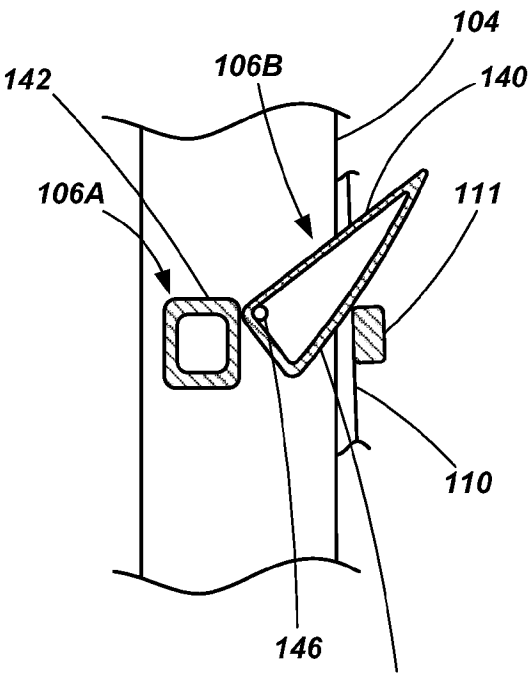
Figure 5A:
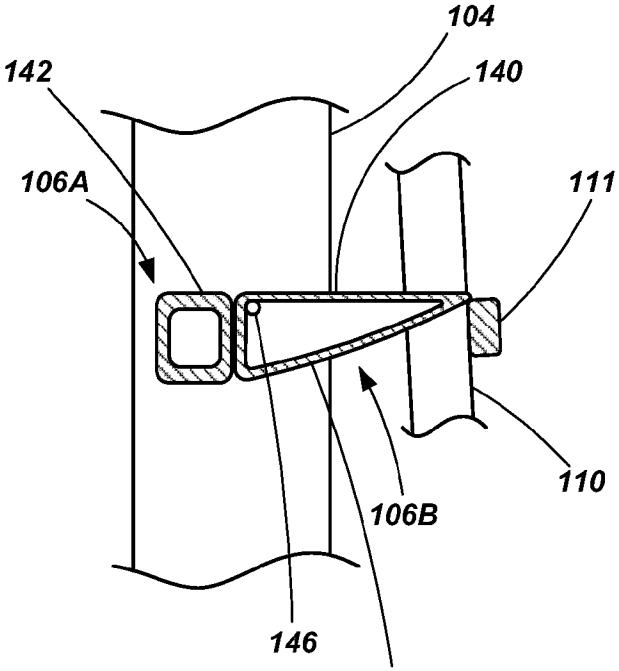

For example, as may be seen best in the cross-sectional views of FIG. 5A, the second component 106B may exhibit substantially triangular cross-sectional geometry with one side (or at least a portion of one side), such as the "short" side of the triangle shown in FIG. 5A, including an abutting surface configured to abut a side surface (or abutting surface) of the first component 106A. As also seen in FIG. 5A, and as noted above, when in the cantilevered position, the upper surface 140 (which may also be referred to as a platform surface or a working surface) of second component 106B is substantially planar with respect to the upper surface 142 (e.g., a platform surface or working surface) of the first component 106A so that they cooperatively define a common working surface for the rung 106. With the second component 106B extending out beyond the plane defined by the back surfaces of the rails 104, the rungs 106 provide an extended or enlarged working surface for a user to stand on in comparison to many conventional ladders.

The underside 144 of the second component 106B provides a ramped surface for engagement with a component of the second assembly 108 during the folding or collapsing of the ladder 100. In one embodiment, the underside of the second component may include a curved surface (e.g., generally convex in cross-sectional profile as seen in FIG. 5A). In another embodiment, the underside 144 of the second component may a generally linear or planar surface.

Still referring to FIG. 5A, the first and second assemblies 102 and 108 are configured such that when they are displaced near one another (i.e., during folding or collapsing of the ladder 100), a bracing member 111 or other component of the second assembly 108 engages the underside 144 of the second component 106B of an associated rung 106. As the first and second assemblies 102 and 108 continue to come closer to each other, the bracing 111 slides beneath the second component 106B, causing the second component 106B to rotate upwards about its hinged or pivoting connection 146 such as seen in FIG. 5B. Continued displacement of the second assembly 108 towards the first assembly 102 causes further rotation of the second component 106B until the ladder is completely folded or collapsed and the second component 106B is rotated upwards within a defined envelope, as discussed above, and is maintained in that position by the bracing 111 or other component of the second assembly 108 as shown in FIG. 5C.

When opening the ladder 100, or transitioning from the stowed/stored state to a deployed state, the second components 106B simply "fall" or rotate back into their cantilevered position by reason of gravity. Again, no linkages, struts or other such components are used to effect rotation of the second components 106B of the rungs 106, or to provide structural support to them when in a cantilevered position. Thus, deployment of the ladder 100, including deployment of the second component 106B, occurs in the reverse order as that shown in FIGS. 5A-5C. When the bracing 111 is no longer in contact with the second component 106B, the second component 106B may be prevented from rotating further by its relationship with the first component 106A as discussed above. In other embodiments, additional stop or abutment members may, for example, be associated with the rails 104 and configured to maintain the second component 106B in a desired deployed position.

Figure 6:
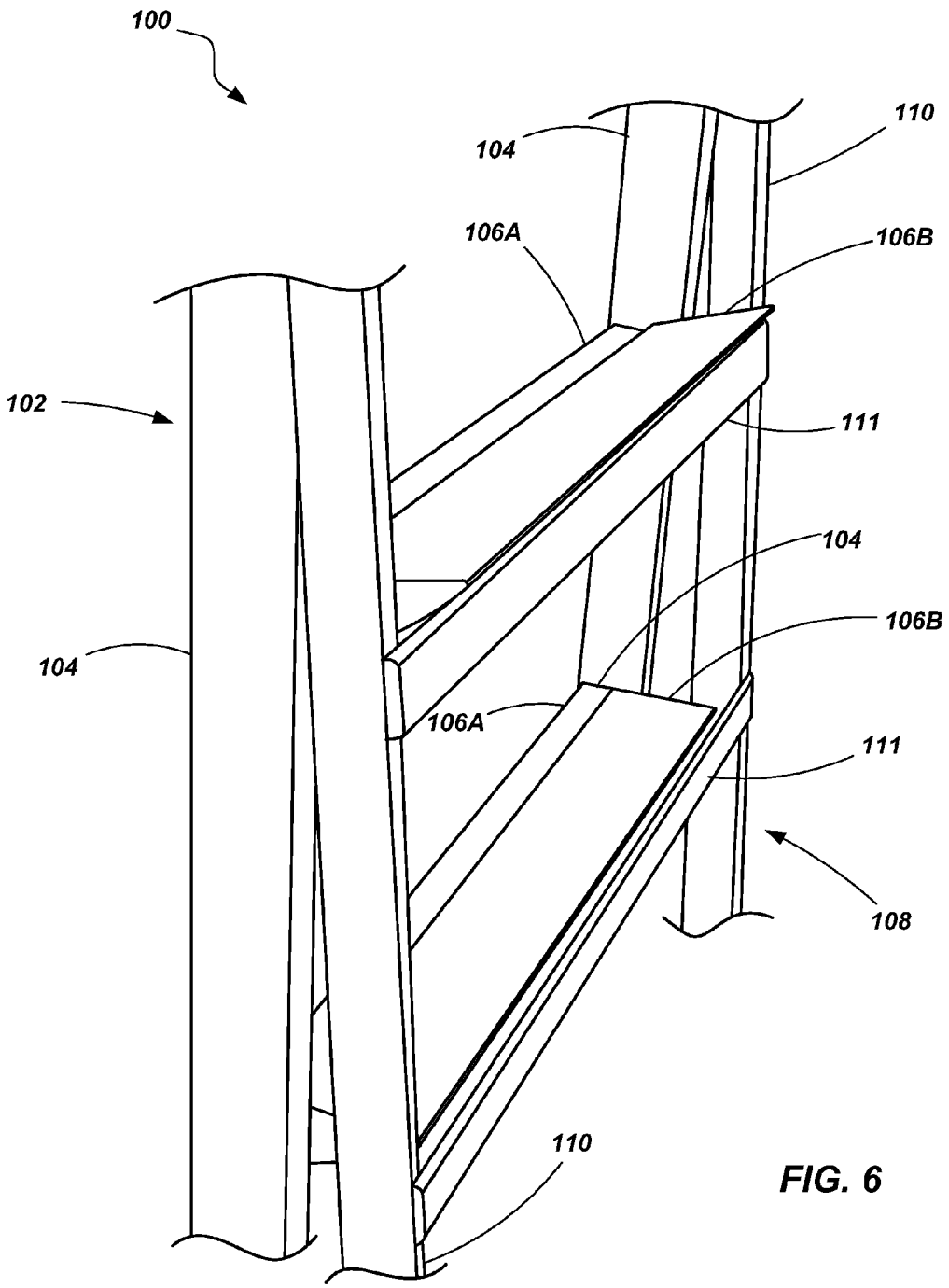
FIG. 6 is another perspective view of a portion of the stepladder shown in FIG. 1 while in a fully closed state.

Referring briefly to FIG. 6, a portion of a ladder 100 is shown in a transitional state (i.e., between a fully deployed state and a fully folded or stored state). As seen in FIG. 6, one of the second components 106B (i.e., the upper rung 106) is engaged by a bracing member 111 and in transition from a deployed state to a stowed state. At the same time, another second component 106B (i.e., the lower rung 106) is not yet engaged by an associated bracing member 111, but will be upon further collapsing of the two assemblies 102 and 108. Thus, the folding of the second components may occur somewhat sequentially, with each second component 106B folding or rotating independent of any other second component 106B.

In certain embodiments, the rungs 106 of the ladder may include additional components. For example, in one embodiment, a flexible material (e.g., rubber or some other polymer material) may extend between the first component 106A and the second component 106B along the upper surface. Such a layer may help to conceal a potential pinch point (e.g., when the second component 106B is rotating relative to the first component 106A) and may help to keep dirt and debris from entering the space between the two components 106A and 106B. The flexible component may also act as a gripping surface to prevent slipping of a user when their foot is placed on the rung 106. In some embodiments, the flexible material may extend to cover part or substantially all of the upper surface of the first component 106A, the second component 106B or both.

Figure 7:
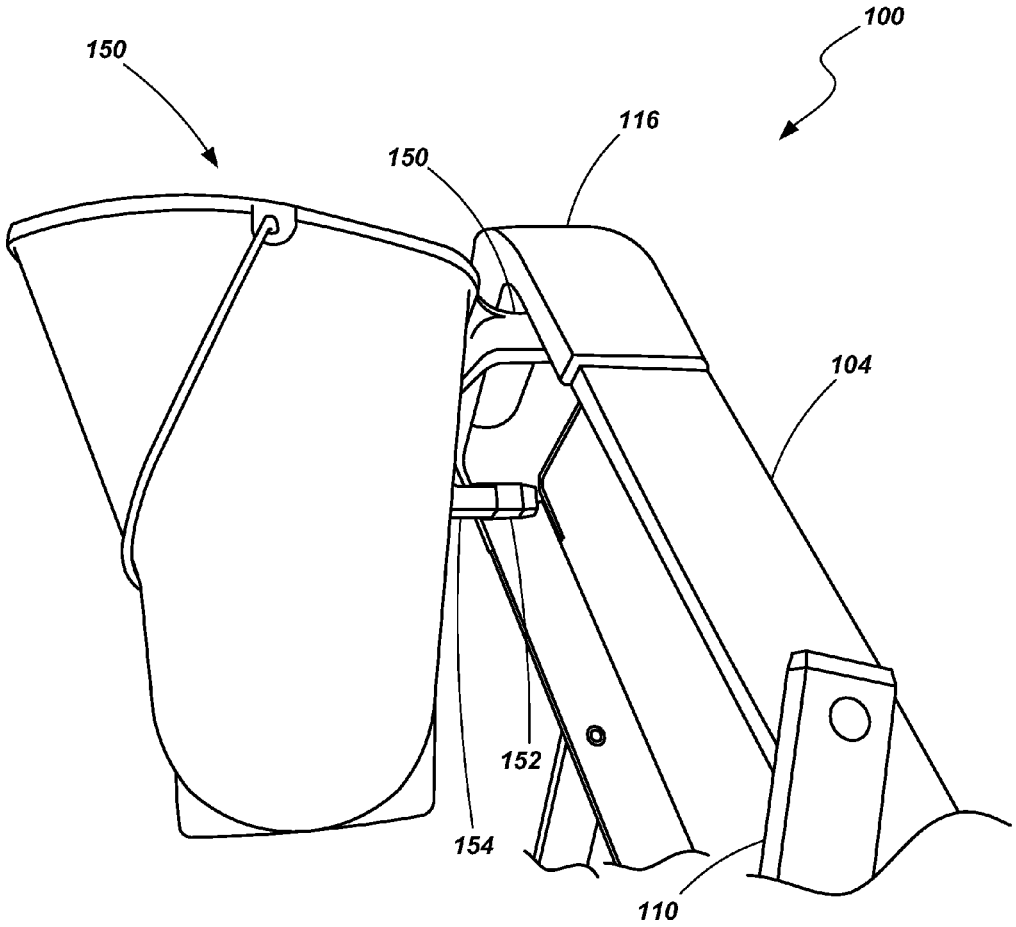
FIG. 7 shows a side perspective view of a portion of the stepladder of FIG. 1 with an accessory coupled therewith.
Figure 8:
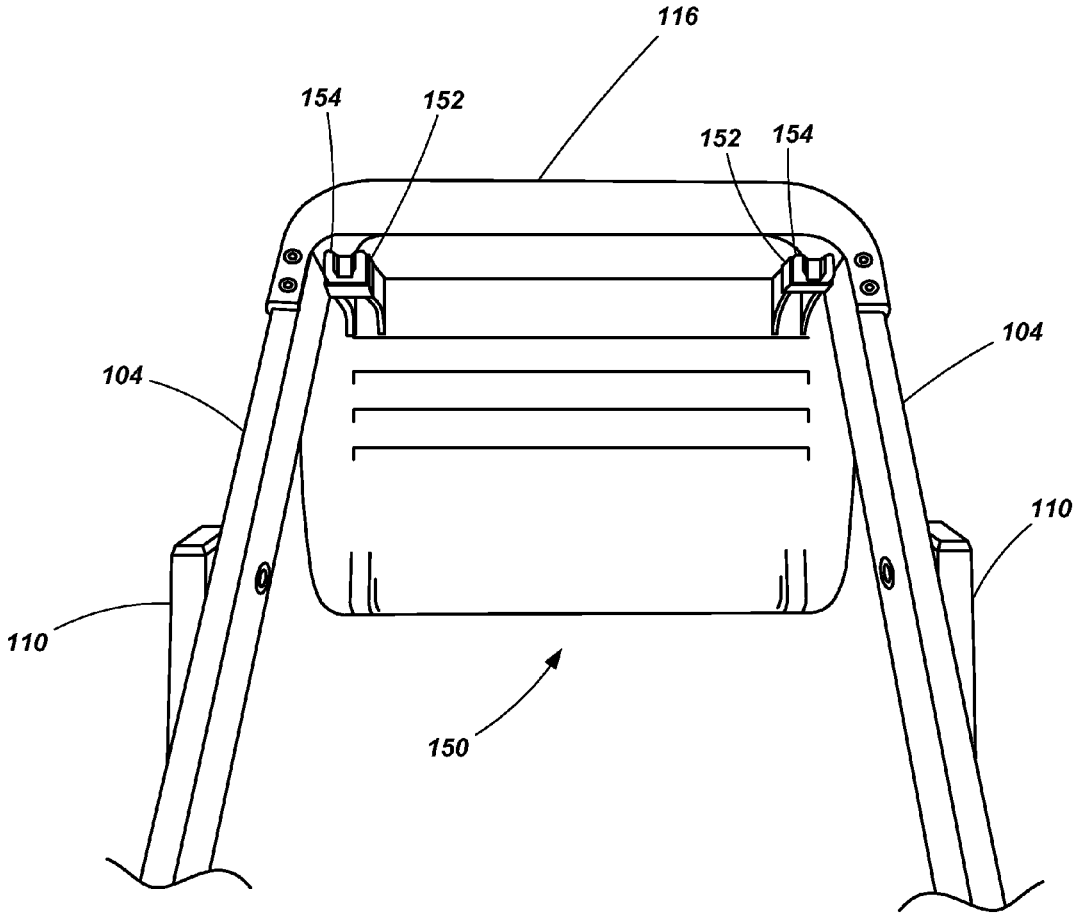
FIG. 8 shows a rear perspective view of a portion of the stepladder of FIG. 1 with an accessory coupled therewith.

The ladder 100 may further include other features and components. For example, as shown in FIGS. 7 and 8, the handle 116 of the ladder 100 may be configured for selective attachment with one or more accessories 150. The accessories may be configured, for example, as a paint bucket shown, a tray, a tool holder or other various structures. In one embodiment, a pair of brackets 152 may be formed in, or otherwise coupled with, the handle 116 and configured to receive connection portions 154 of the accessory 150. The connecting portions 154 may include protrusions or clips sized and configured to extend through and engage the brackets 152 to hold the accessory in place relative to the handle 116. Thus, in one embodiment, the accessory 150 may be attached by pushing the connection portions 154 through the brackets 152 until they are snugly in place, or until a positive lock holds them in place. The accessory 150 may be removed and replaced by a different accessory when desired by a user of the ladder 100. It is noted that examples of various accessories and attachment systems are described in U.S. patent application Ser. No. 12/774,637 (Publication No. 2010/0282540) filed on May 5, 2010, entitled LADDERS, LADDER COMPONENTS, LADDER ACCESSORIES, LADDER SYSTEMS AND RELATED METHODS and U.S. patent application Ser. No. 13/402,013, filed on Feb. 22, 2012, entitled LADDER, LADDER COMPONENTS AND RELATED METHODS, the disclosures of which are incorporated by reference herein in their entireties.

Other features and components may include, for example, feet 130 on the ends of the rails 104 and 110 which may be configured as clip on components such as described in the above referenced U.S. patent application Ser. No. 13/402,013.

While the invention may be susceptible to various modifications and alternative forms, specific embodiments have been shown by way of example in the drawings and have been described in detail herein. Of course, one or features of one described embodiment may be utilized in conjunction with one or more features of another described embodiment. It should be understood that the invention is not intended to be limited to the particular forms disclosed. Rather, the invention includes all modifications, equivalents, and alternatives falling within the spirit and scope of the invention as defined by the following appended claims.

What is claimed is:

1. A ladder comprising:

a first assembly having a pair of spaced apart rails and at least one rung extending therebetween, each of the pair of spaced apart rails having a front surface and a back surface, the front surfaces and the back surfaces of the pair of spaced apart rails defining a volumetric envelope;

a second assembly having a pair of spaced apart rails, the second assembly being hingedly coupled with the first assembly;

wherein the at least one rung comprises:

a first component extending between and fixedly coupled to the pair of rails of the first assembly, the first component including at least a first surface and a second surface;

a second component extending between and rotatably displaceable relative to the pair of rails of the first assembly, the second component having at least a first surface and a second surface, wherein when in a first position, the first surface of the first component and the first surface of the second component are substantially coplanar and the second surface of the second component abuts the second surface of the first component such that rotation in a first direction is prohibited, wherein when in the first position, a first portion of the second component's first surface is located within the volumetric envelope and a second portion of the second component's first surface extends beyond the back surfaces and outside of the volumetric envelope and, wherein, when in a second position, the second component is substantially positioned within the volumetric envelope;

at least one bracing member extending between and coupled to the pair of rails of the second assembly, and wherein when the second assembly is rotated adjacent the first assembly, the at least one bracing member contacts an undersurface of the second component of the at least one rung and is configured to push against the undersurface of the second component and rotate the second component in a second direction opposite the first direction.

2. The ladder of claim 1, further comprising a platform rotatably coupled with the first assembly and configured to selectively engage the second assembly.

3. The ladder of claim 2, further comprising a locking mechanism configured to selectively lock the platform with a component of the second assembly.

4. The ladder of claim 1, wherein the rails of the first assembly extend beyond a hinge point between the first and second assemblies.

5. The ladder of claim 4, further comprising a handle extending between and coupling upper ends of the pair of rails of the first assembly.

6. The ladder of claim 5, wherein the handle is configured for selective coupling with at least one accessory.

7. The ladder of claim 1, wherein the at least one rung includes a plurality of rungs.

8. The ladder of claim 1, wherein the pair of spaced apart rails of the second assembly at least partially overlap with the pair of spaced apart rails of the first assembly when the ladder is in a collapsed state.

9. The ladder of claim 1, wherein the second component is directly pivotally coupled with the pair of spaced apart rails of the first assembly.

10. The ladder of claim 2, wherein the at least one rung includes a plurality of rungs, each rung of the plurality of rungs including a first component extending between and fixedly coupled to the pair of rails of the first assembly and a second component extending between and rotatably displaceable relative to the pair of rails of the first assembly.

* * * * *